United States Patent [19]

Hasuda et al.

[11] 3,961,652

[45] June 8, 1976

[54] TAPE STRINGER FOR SLIDING CLASP FASTENERS

[76] Inventors: Minoru Hasuda, No. 265, Tenjinshin, Kurobe, Toyama; Yasuo Yamada, No. 4024, Mikkaichi, Kurobe, Toyama, both of Japan

[22] Filed: Sept. 4, 1974

[21] Appl. No.: 503,067

Related U.S. Application Data

[63] Continuation of Ser. No. 378,251, July 11, 1973, abandoned, which is a continuation of Ser. No. 783,049, Dec. 11, 1968, abandoned.

[30] Foreign Application Priority Data

| | | |
|---|---|---|
| Sept. 28, 1967 | Japan | 42-12440 |
| Dec. 21, 1967 | Japan | 42-82156 |
| July 23, 1968 | Japan | 43-51947 |

[52] U.S. Cl. ..... 139/384 B; 24/205.16 C

[51] Int. Cl.[2] ..... D03D 3/00

[58] Field of Search ..... 139/384 R, 384 A, 116, 139/35, 384 B; 24/205.1 R, 205.1 C, 205.16 R, 205.16 C

[56] References Cited

UNITED STATES PATENTS

| | | | |
|---|---|---|---|
| 3,022,803 | 2/1962 | Berberich et al. | 139/384 A |
| 3,179,996 | 4/1965 | Class | 24/205.1 C |
| 3,249,126 | 5/1966 | Gerlach et al. | 139/384 A |
| 3,266,114 | 8/1966 | Gerlach et al. | 139/384 A |
| 3,444,598 | 5/1969 | Glindmeyer et al. | 139/384 A |
| 3,454,052 | 7/1969 | Burbank | 139/384 A |

FOREIGN PATENTS OR APPLICATIONS

| | | | |
|---|---|---|---|
| 1,542,750 | 9/1968 | France | 24/205.16 C |
| 1,167,578 | 4/1964 | Germany | 139/384 A |
| 6,804,649 | 10/1968 | Netherlands | 24/205.16 C |
| 187,831 | 2/1964 | Sweden | 24/205.16 C |
| 1,086,520 | 10/1967 | United Kingdom | 24/205.16 C |

*Primary Examiner*—Mervin Stein
*Attorney, Agent, or Firm*—Robert E. Burns; Emmanuel J. Lobato; Bruce L. Adams

[57] ABSTRACT

A tape stringer for a sliding clasp fastener having a web section and a woven filament section forming an end section of a tape. Both the web and the woven filament sections include a plurality of warp threads interwoven with a continuous weft thread and the woven filament section includes a spiral-shaped continuous plastic filament woven into the filament section. The spiral-shaped continuous plastic filament forms a row of connected together loops having coupling heads projecting beyond the end of the tape and having limbs that are inserted in and secured to the end section of the tape by the warp threads which engage the limbs along substantially their entire length.

7 Claims, 27 Drawing Figures

INVENTOR.

BY

INVENTOR.

BY

INVENTOR.

BY

INVENTOR.

BY

INVENTOR.

BY

INVENTOR.

BY

INVENTOR.

BY

INVENTOR.

BY

INVENTOR.

BY

INVENTOR.

BY

TAPE STRINGER FOR SLIDING CLASP FASTENERS

This is a continuation of application Ser. No. 378,251, filed July 11, 1973, now abandoned, which is a continuation application of prior application Ser. No. 783,049 filed Dec. 11, 1968 and now abandoned.

This invention relates to a sliding clasp fastener stringer and has particular reference to the type of fastener stringer in which the coupling means consists of a continuous plastic filament spirally formed and woven into the edge of a carrier tape during the weaving thereof.

While there have been introduced a number of sliding clasp fasteners of this character wherein the coupling fastener members are formed from a single plastic filament and secured to the edge of the tape at the time the latter is woven, they may be grouped broadly into two categories. One is the case where the filament is preformed into a coiled or spirally-arranged construction and such preformed filament is interwoven as the warp along the edge of the tape during the weaving operation. The other type is characterized in that a continuous, linear filament is woven on a shuttle loom in a manner similar to a weft thread and formed, in the course of weaving, into a spirally-arranged interlocking structure.

These prior-art devices have many advantages as such, but they also have a certain problem particularly as regards the mechanical strength with which the interengaging coiled filament members are secured to the carrier tape; viz., these members are too loosely anchored in place and lend themselves to displacement or deformation upon the imposition of tension or pull on tape stringers.

More recent devices have been conceived to eliminate this problem by the use of, for instance, a cord or a reinforcing thread for securing the filament members harder to the edge of the tape, which in turn presents a drawback that the filament-woven edge portion of the tape become objectionably thick and complicated.

It is the general object of the present invention to provide an improved sliding clasp fastener stringer of this character which will overcome the above-noted difficulties.

This object is achieved essentially by the construction of a tape stringer wherein both limbs of each of the convolutions of the coiled filament are inserted in and secured by one and the same group of loops formed by warp threads during the shedding thereof when weaving a carrier tape, and the said limbs are firmly anchored in position on the edge of the tape on one side thereof by as many warp threads as required to substantially cover the entire length of the said limbs, the density of warp threads being greater at the tape edge portion securing the filament than at a filament free web portion of the tape.

The invention owes its merits essentially to the double pick weaving or needle loom operation wherein a continuous pliable filament is woven in double picks in very much the same way as a textile weft thread is woven with textile warp threads into a fabric tape.

The above object and other features of the invention will be more apparent from the following description, and will be particularly pointed out in the appended claims.

In the accompanying drawings, there are shown for the purpose of illustration certain preferred embodiments which the present invention may assume in practice.

Figure 11:
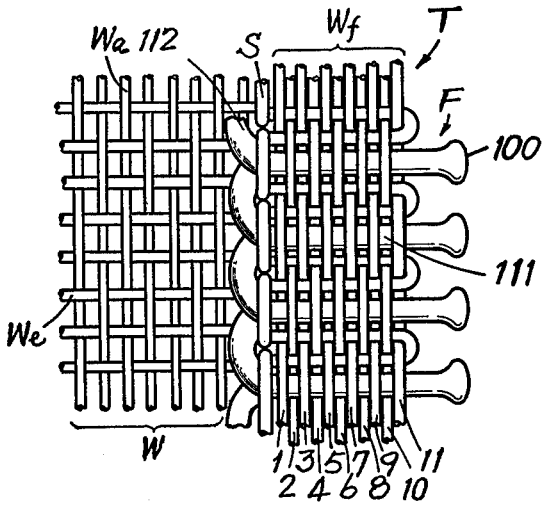
Figure 12:
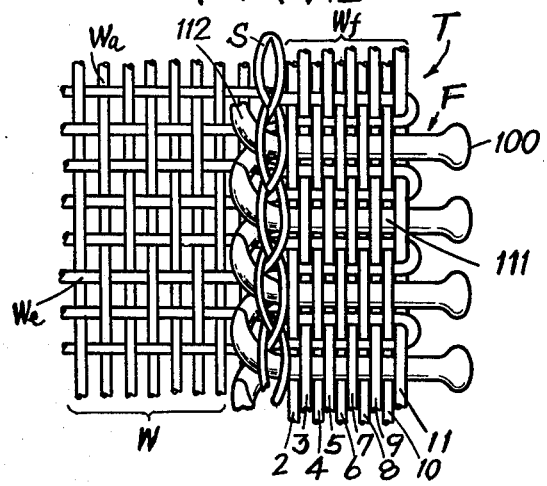
Figure 13:
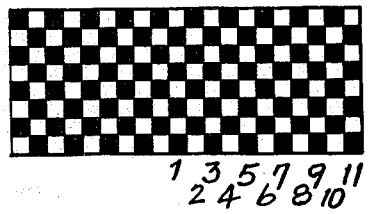
Figure 14:
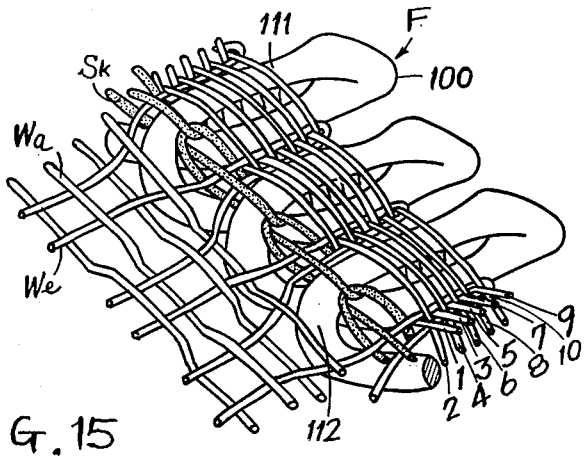
Figure 15:
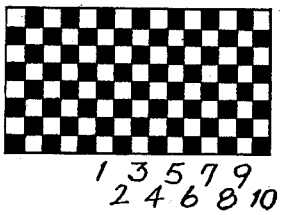
Figure 16:
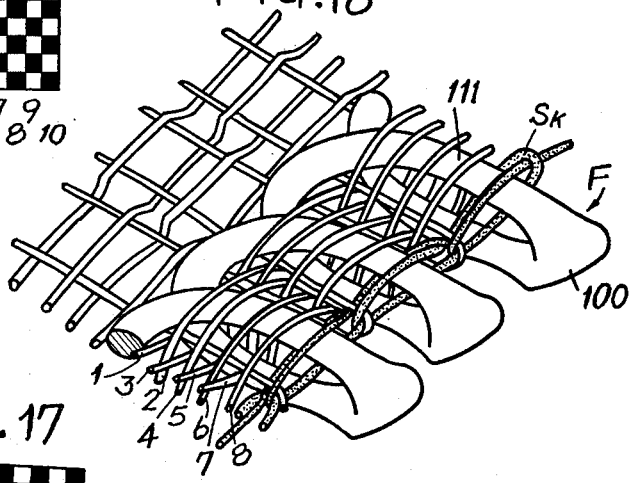
Figure 17:
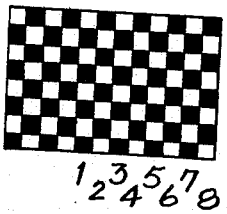
Figure 18:
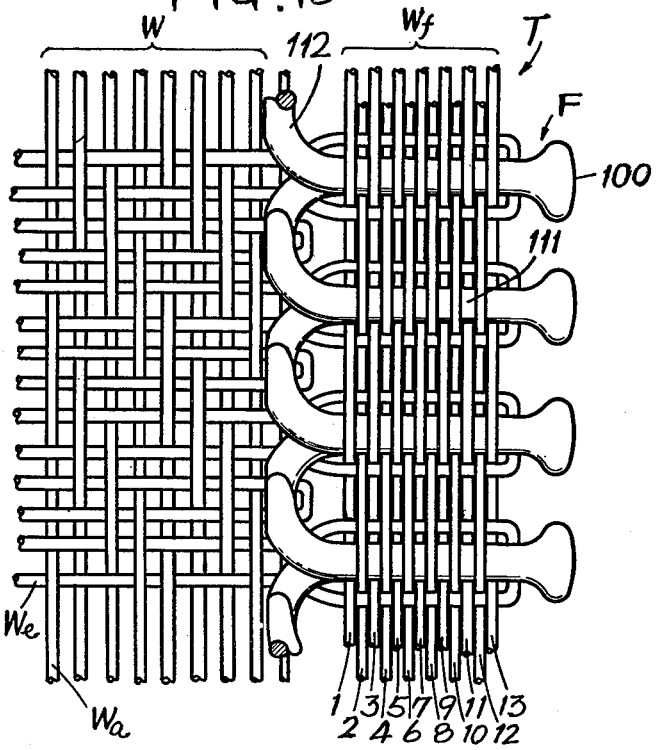
Figure 19:
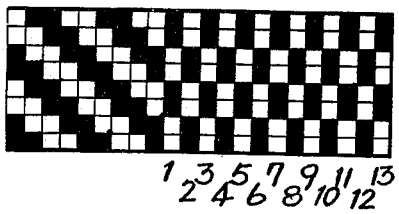
Figure 20:
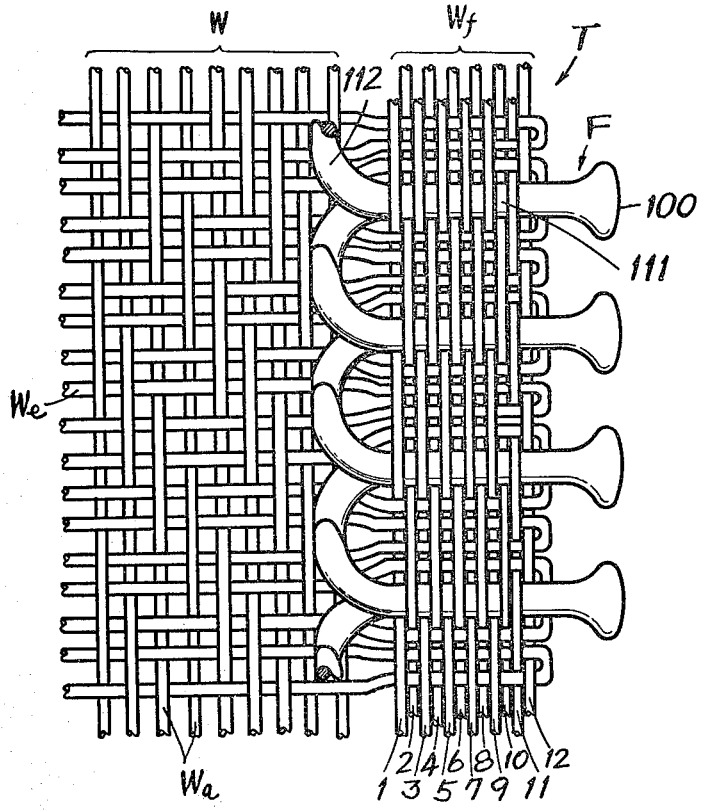
Figure 21:
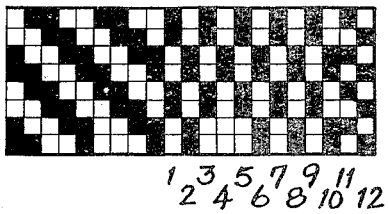
Figure 22:
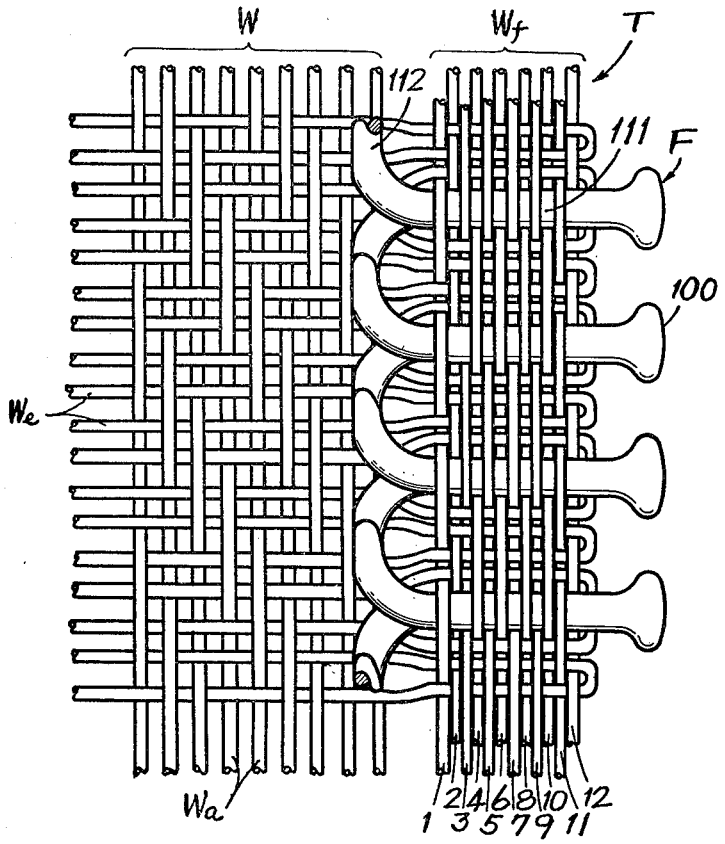
Figure 23:
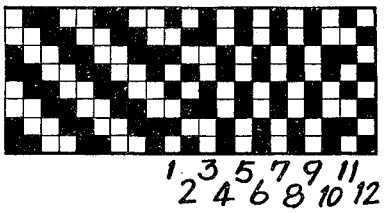
Figure 24:
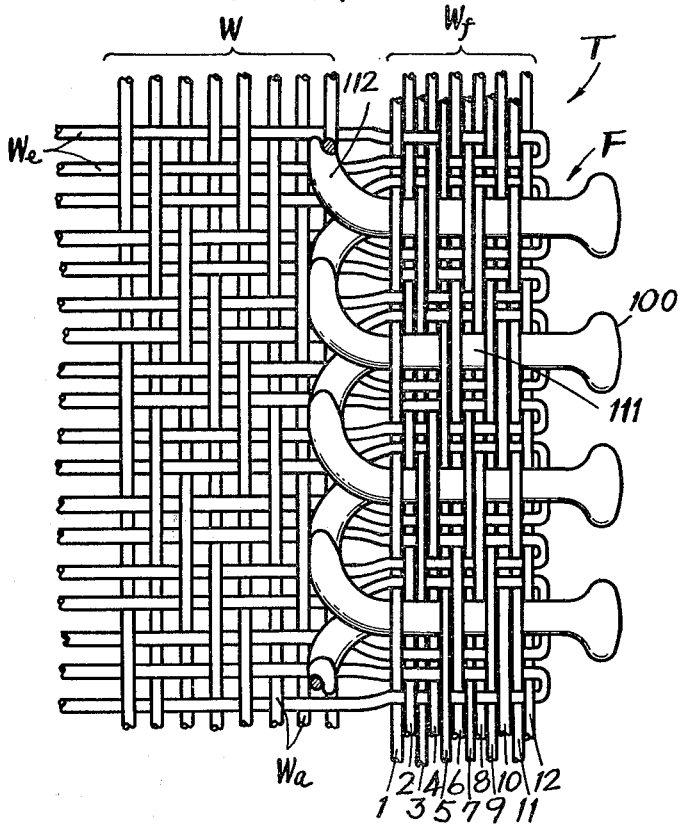
Figure 25:
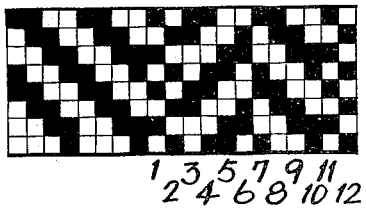
Figure 26:
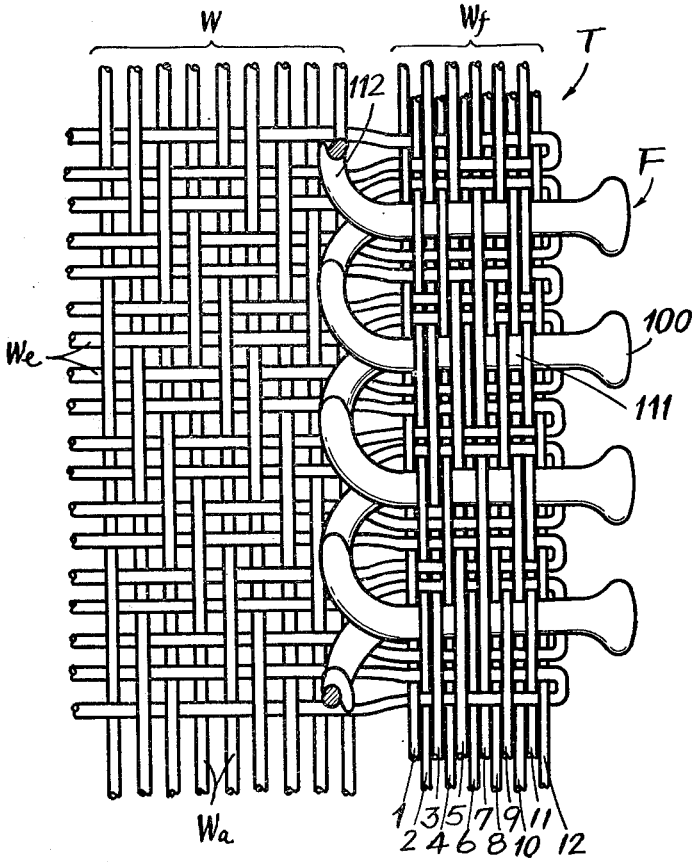
Figure 27:
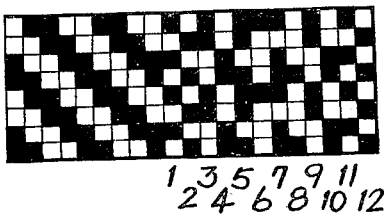

FIGS. 11 to 12 represent a fourth embodiment, FIG. 11 being a magnified diagrammatic plan view of a tape stringer fragment incorporating a sewing thread stiffener as lock-stitched in the tape, FIG. 12 being a similar view to FIG. 11 but incorporating a sewing thread stiffener as chain-stitched in the tape, and FIG. 13 being a weaving pattern for producing the tape stringer shown either in FIG. 11 or FIG. 12;

FIG. 14 is a magnified diagrammatic perspective view of a fifth embodiment showing a knitting string as used to stiffen the rear end portions of the limbs of the coiled filament;

FIG. 15 is a weaving pattern for producing the tape stringer shown in FIG. 14;

FIG. 16 is a similar view to FIG. 14 but showing the knitting string in position to stiffen the fore end portions of the limbs;

FIG. 17 is a weaving pattern for producing the tape stringer shown in FIG. 16;

FIG. 18 is a magnified diagrammatic plan view of a sixth embodiment showing a modified weft to warp design of the tape stringer;

FIG. 19 is a weaving pattern for producing the tape stringer shown in FIG. 18;

FIG. 20 is a magnified diagrammatic plan view of a seventh embodiment showing another modification of the weft to warp design of the tape stringer;

FIG. 21 is a weaving pattern for producing the tape stringer shown in FIG. 20;

FIG. 22 is a magnified diagrammatic plan view of an eighth embodiment showing a further modification of the weft to warp design;

FIG. 23 is a weaving pattern for producing the tape stringer shown in FIG. 22;

FIG. 24 is a magnified diagrammatic plan view of a ninth embodiment showing a still further modification of the weft to warp design of the tape stringer;

FIG. 25 is a weaving pattern for producing the tape stringer shown in FIG. 24;

FIG. 26 is a magnified diagrammatic plan view of a tenth embodiment showing a still another modification of the weft to warp design of the tape stringer;

FIG. 27 is a weaving pattern for producing the tape stringer shown in FIG. 26.

Figure 1:
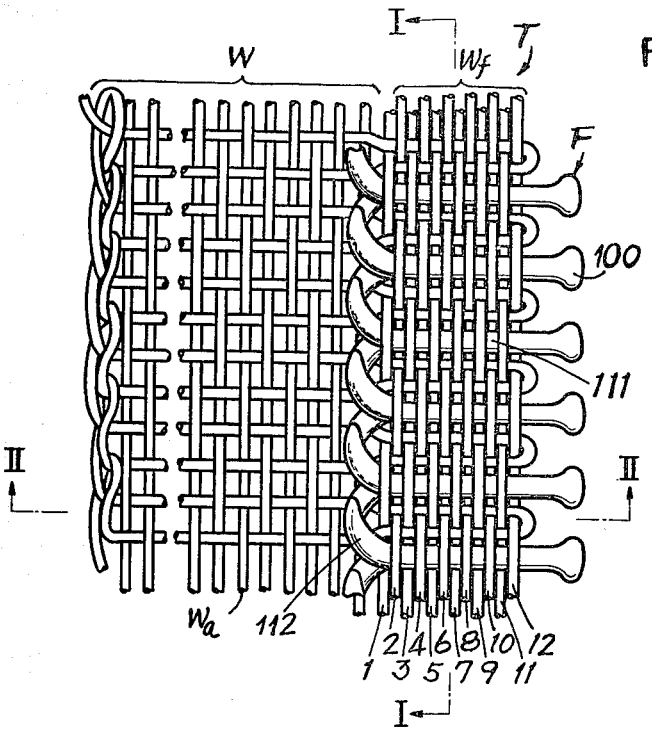
FIG. 1 is a magnified diagrammatic plan view of a fragment of the tape stringer constructed in accordance with the invention.

In FIG. 1 of the drawings, there is shown a tape stringer T which constitutes one part of a pair of stringers for a sliding clasp fastener. This stringer consists of a web section W and a woven filament section W*f* constituting an edge of a tape, both sections consisting of a plurality of warp threads interwoven with double picks of a continuous weft thread. The latter section W*f* has a continuous, spirally-arranged coupling filament woven into the edge of the tape. As already stated, the filament F is woven practically in the same manner as is the weft thread by the double-pick weaving procedure known in the art. The filament F is formed into a continuous, spirally-arranged structure consisting of a series of elongated convolutions projecting outwardly of the tape edge thereby defining a row of successively connected together elongated convolution or loops. Each convolution has a coupling head to engage and couple with corresponding head of convolution in an opposed stringer (not shown), two limbs or legs III, substantially superimposed on the other, and a connecting portion 112 interconnecting adjacent limbs.

Figure 2:
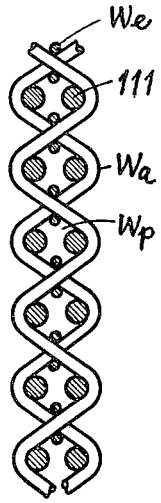
FIG. 2 is a longitudinal cross-sectional view taken on line I—I of FIG. 1, schematically showing the two limbs, upper and lower, of each convolution of the coiled filament as run through and anchored in one and the same group of warp thread loops.

As seen in FIGS. 1 and 2, the woven filament section W*f* comprises a first plurality of warp threads 1, 3, 5, 7, 9 which alternately overlie and underlie successive ones of the elongated loops and a second plurality of warp threads 2, 4, 6, 8, 10, 12 which alternately underlie and overlie the same successive ones of the elongated loops. The first and second pluralities of threads are disposed entirely exteriorly of the loops (as best seen in FIGS. 14 and 16) and are composed of sufficient numbers of warp threads so as to extend along substantially the entire length of each limb 111 and such a dense arrangement of warp threads aids in strengthening the overall stringer tape assembly.

Figure 6:
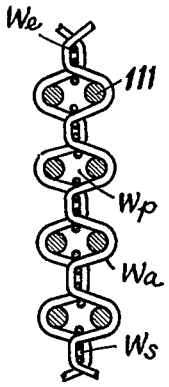

Throughout the various embodiments shown, both limbs 111 of a convolution or elongated loop of the filament F are accommodated, one superimposed on the other, in one and the same group of warp thread loops W*p* as illustrated particularly in FIG. 2 or FIG. 6, which constitutes an important aspect of the present invention. Another important aspect is found in arranging as many warp threads W*a* as may fill the entire region of the limbs 11 extending between the coupling head 100 and the connecting portion 112 of each convolution in the woven filament section W*f*. These two basic arrangements according to the invention assure a fixation of the filament F to the edge of the carrier tape with greater firmness than achieved by the prior-art devices. It will be also understood that the tape stringer T may be rendered substantially thin and pliable as a whole due to the accommodation of both limbs 111 in one and the same group of warp thread loops different from the conventional counterparts wherein the two limbs are secured in two separate loops.

Figure 3:
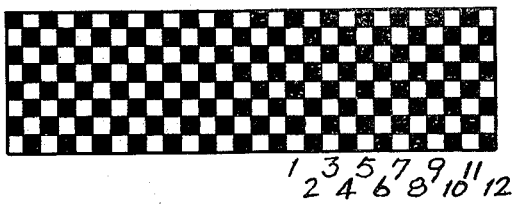
FIG. 3 is a weaving pattern for producing the tape stringer shown in FIG. 1.
Figure 4:
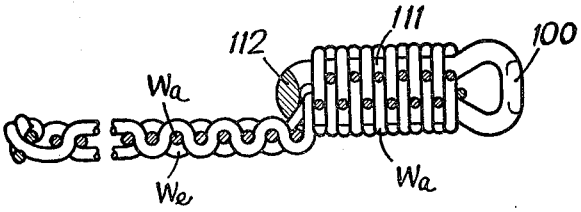
FIG. 4 is a transverse cross-sectional view taken on line II—II of FIG. 1.

The weaving pattern or weaver's diagram shown in FIG. 3 is utilized to explain the weave system of the tape stringer in FIG. 1, and it is known as a plain weave. The left-hand side of this diagram represents the weave of the web section W, and the right-hand side represents the weave of the woven filament section W*f*. The black squares correspond to an up position of the warp thread W*a*, and the white squares to a down position thereof. This diagram arrangement applies to all of the rest of the weaving patterns shown. FIG. 4 shows a transverse cross-sectional view of the tape stringer T shown in FIG. 1.

Figure 5:
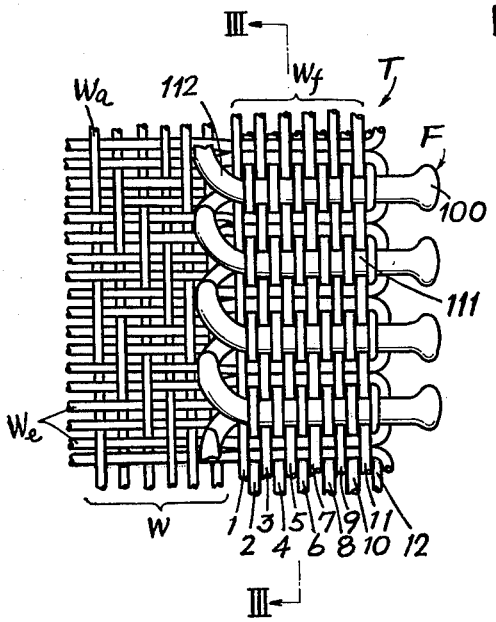
FIGS. 5 to 7 represent a second embodiment of the invention, FIG. 5 being a magnified diagrammatic plan view of a tape stringer fragment, FIG. 6 being a longitudinal cross-sectional view taken on line III—III of FIG. 5, and FIG. 7 being a weaving pattern for producing the tape stringer shown in FIG. 5.
Figure 7:
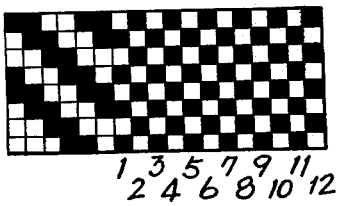

The second embodiment shown in FIGS. 5 to 7 is characterized by the provision of sub-loops W*s* each alternating with the large loop W*p* and accommodating a double pick of a weft thread W*e* interwoven with the warp threads W*a* between two adjacent convolutions of the filament F, as better seen in FIG. 6. This stringer construction is suitable particularly for a relatively large interlocking filament. The web section W is a two-and-two twill weave, while the woven filament section W*f* is a plain weave, as diagrammatically shown in FIG. 7.

Figure 8:
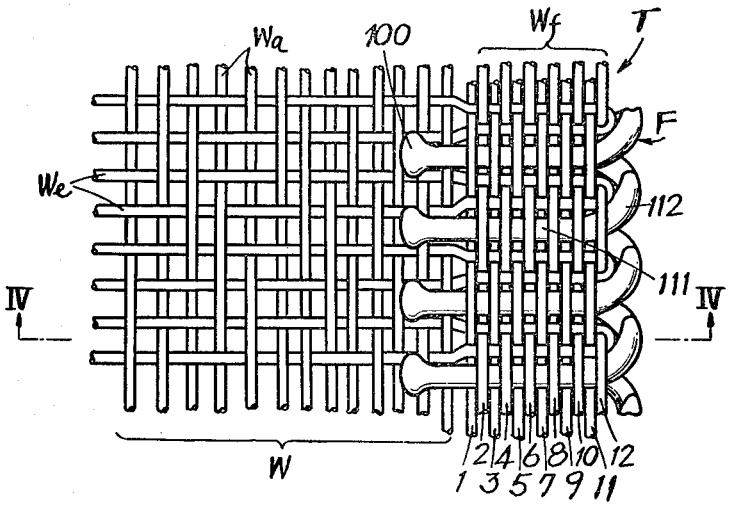
FIGS. 8 to 10 represent a third embodiment, FIG. 8 being a magnified diagrammatic plan view of a tape stringer fragment, FIG. 9 being a weaving pattern for producing the tape stringer shown in FIG. 8, and FIG. 10 being a transverse cross-sectional view taken on line IV—IV of FIG. 8 showing the tape as folded back to be adapted as a masked sliding clasp fastener.
Figure 9:
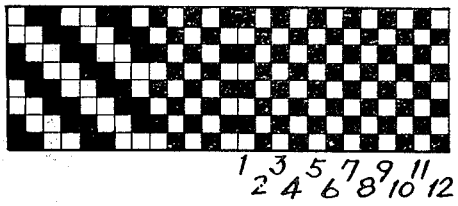
Figure 10:
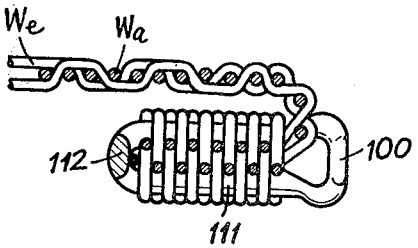

The third embodiment appears in FIGS. 8 to 10, which is intended for use as a stringer for a masked sliding clasp fastener. Contrary to the rest of the ordinary types of fastener stringers shown, the filament F in this embodiment is woven in place as it passes through the warp threads W*a* in the same direction as the weft thread W*e* is forwarded on a needle loom (not shown), so that the resulting coupling head of each loop or convolution projects inwardly of the edge of the tape. FIG. 10 shows this masked type of fastener stringer with the web section W folded back near the coupling head 100, so as to cause this head to protrude and be clear of the tape. The folded part of the tape is reinforced by weaving this part in a plain design. As shown in the weaving pattern of FIG. 9, the first to fifth warp threads of the web section W are in plain weave, while the remaining sixth to 13th warp threads are in two-and-two twill weave. The woven filament section W*f* consists of a plain weave.

The fourth embodiment, FIGS. 11 to 13, is similar to the first embodiment shown in FIGS. 1 to 4, except for the provision of a sewing thread stiffener S to hold the filament F securely in position on the tape. The stringer T shown in FIG. 11 has the stiffener S sewn thereon by lock-stitch, while this stiffener S is chain-stitched in the stringer T of FIG. 12. The weave of these two stringers is plain both in the web and filament sections, as seen from the weaving pattern of FIG. 13.

The fifth embodiment, FIGS. 14 to 17, is similar to the fourth embodiment just described, except that a knitting string stiffener S*k* is used in place of the sewing thread stiffener S. In the stringer T shown in FIG. 14, the stiffener S*k* of knitting string is adapted to fasten the rear end portions of the limbs 111 of the filament F securely to the edge of the tape. The stiffener S*k* in the case of FIG. 16 is disposed to fasten the fore end portions of the limbs 11. The weaving patterns for producing these two tape stringers T are shown in FIGS. 15 and 17, respectively.

In FIGS. 18 and 19, there is shown a sixth embodiment of the invention in which the woven filament section W*f* consists of a modified weave other than the plain weave described in the previous embodiments. As shown in the weaving pattern of FIG. 19, the woven filament section W*f* of the stringer T consists of a two-and-two rib weave, while the web section W consists of a two-and-two twill weave. This weft to warp design may be achieved by delivering two or more picks of a weft thread in the web section W for every pitch of the coiled filament F that is woven. This weaving arrangement is common for the remaining seventh to tenth embodiments of the invention hereafter described. It permits the weave of the woven filament section W*f* to be nearly as dense as that of the web section W, and the tape stringer T may be also rendered relatively thin and hence, pliable.

The seventh embodiment, FIGS. 20 and 21, a weave modification wherein the first to 10th warp threads of the woven filament section W*f* are in rib weave with the 11th and 12th warps in plain weave.

In the eighth embodiment, FIGS. 22 and 23, the woven filament section W*f* of the tape stringer T has the first and second warp threads woven in plain weave, the third to 10th in two-and-two rib weave, and the 11th and 12th in plain weave.

The ninth embodiment, FIGS. 24 and 25, is similar to the eighth embodiment just described, except that the third to 10th warp threads are woven in two-and-two twill weave.

In FIGS. 26 and 27, there is shown a tenth embodiment of the invention chosen for purposes of illustration. The woven filament section W*f* of the stringer T appearing in this last embodiment has the first and second warp threads woven in plain weave, the third and fourth in two-and-two rib weave, the fifth to eighth in 3/1 and 1/3 weave, the ninth and 10th in two-and-two rib weave, and the 11th and 12th in plain weave.

While the several embodiments have been described which are believed to be preferred, it will be understood that the present invention is not to be limited to the precise forms which have been advanced, but various modifications and changes may be made therein without departing from the scope of the appended claims. For instance, a nylon or similarly strong thread may be inserted as a warp thread for further increasing the strength with which the filament is fixed to the tape edge.

What is claimed is:

1. In combination:

a. a row of successively connected together elongated loops, each of said loops having a coupling portion at one end thereof dimensioned to releasably couple with mating loops of another row of loops, and an upper leg and a lower leg extending from said coupling portion in a common direction, said upper leg and said lower leg each having a portion remote from said coupling portion connected to a next adjacent one of said loops;

b. a stringer tape comprising a continuous weft thread extending in a transverse dimension of said tape and having an extent defining the width of said tape, said continuous weft thread having portions disposed between each adjacent pair of said elongated loops and coextensive with substantially the entire length of the legs of the loops, a first plurality of threads extending longitudinally of said stringer tape and alternately overlying an upper leg and underlying a lower leg of successive ones of said elongated loops, said first plurality of threads being interwoven with the portions of said continuous weft thread between said elongated loops and disposed extending substantially the entire length of the legs of said loops, a second plurality of threads extending longitudinally of said stringer tape and alternately underlying a lower leg and overlying an upper leg of said successive ones of said elongated loops, said second plurality of threads being interwoven with the portions of said continuous weft thread between said elongated loops and disposed extending substantially the entire length of the legs of said loops, and a plurality of warp threads extending longitudinally of said stringer tape and interwoven with said continuous weft thread to jointly define therewith a web portion of said stringer tape; and c. a sewing thread fastening said elongated loops to the interwoven combination of said first and said second plurality of threads and said portions of said continuous weft thread disposed between each adjacent pair of said elongated loops.

2. A combination according to claim 1; wherein respective ones of said first plurality of threads are alternately positioned with respect to respective ones of said second plurality of threads along the length of said legs of said loops.

3. A combination according to claim 1; wherein said portions of said continuous weft thread disposed between each adjacent pair of said elongated loops comprise double picks of said continuous weft thread.

4. A combination according to claim 3; wherein said first plurality and said second plurality of threads and said portions of said continuous weft thread comprise a plain weave.

5. A combination according to claim 3; wherein said first plurality and said second plurality of threads and said portions of said continuous weft thread comprise a twill weave.

6. A combination according to claim 3; wherein said first plurality and said second plurality of threads and said portions of said continuous weft thread comprise a rib weave.

7. A combination according to claim 1; wherein said portions of said continuous weft thread disposed between each adjacent pair of said elongated loops comprise at least three picks of said continuous weft thread.

* * * * *